US007017751B2

(12) United States Patent
Clark et al.

(10) Patent No.: US 7,017,751 B2
(45) Date of Patent: Mar. 28, 2006

(54) SYSTEM AND METHOD FOR AUTOMATED UNPACKING

(75) Inventors: Jessica Woods Clark, Round Rock, TX (US); Reed Dravigne, Austin, TX (US)

(73) Assignee: Dell Products L.P., Round Rock, TX (US)

( * ) Notice: Subject to any disclaimer, the term of this patent is extended or adjusted under 35 U.S.C. 154(b) by 0 days.

(21) Appl. No.: 10/673,126

(22) Filed: Sep. 26, 2003

(65) Prior Publication Data

US 2005/0066627 A1 Mar. 31, 2005

(51) Int. Cl.
*B65D 85/00* (2006.01)

(52) U.S. Cl. ..... 206/725; 206/720; 206/722; 206/466; 383/38

(58) Field of Classification Search ..... 493/95, 493/100, 94, 90, 91; 206/725, 720, 722, 206/701, 466; 383/38, 39; 83/158, 542
See application file for complete search history.

(56) References Cited

U.S. PATENT DOCUMENTS 2,745,545 A * 5/1956 Dunning ..... 206/466
2,801,002 A * 7/1957 Irwin et al. ..... 206/466
2,954,140 A * 9/1960 Sutherland ..... 217/53
4,691,469 A * 9/1987 Alsobrook et al. ..... 43/54.1
4,691,827 A * 9/1987 Grace et al. ..... 206/465
5,249,685 A * 10/1993 Stephens ..... 206/523
5,405,000 A * 4/1995 Hagedon et al. ..... 206/216
5,477,966 A * 12/1995 Ogawa ..... 206/723
6,050,420 A 4/2000 Green ..... 206/764
6,076,681 A * 6/2000 Chenoweth ..... 206/714
6,152,305 A 11/2000 Green ..... 206/764
6,158,590 A * 12/2000 Fujikawa et al. ..... 206/720
6,367,632 B1 4/2002 Green ..... 206/764
6,427,842 B1 8/2002 Green ..... 206/764

* cited by examiner

*Primary Examiner*—Eugene Kim
*Assistant Examiner*—Christopher R. Harmon
(74) *Attorney, Agent, or Firm*—Hamilton & Terrile, LLP; Robert W. Holland

(57) ABSTRACT

Bulk packaging of information handling system components in partitions of a container with a protective bag for each component accommodates robotic extraction of components and recycling of the packaging material with a polyethylene protective bag having die cut features that aid in retention of the protective bag in a partition during extraction of the component without adhering the protective bag to the container. Opposing rectangular tie extensions associated with the upper portion of the protective bag couples to a slot of the container to restrain the protective bag from removal from the container. Opposing triangular openings cut in the bottom portion of the protective bag relieve vacuum generated by removal of the component from the protective bag so that the protective bag remains in the partition during robotic extraction of the component to prevent interference by the protective bag with the robotic vision used to acquire the component.

5 Claims, 3 Drawing Sheets

SYSTEM AND METHOD FOR AUTOMATED UNPACKING

BACKGROUND OF THE INVENTION

1. Field of the Invention

The present invention relates to the field of automated unpackaging, and more particularly to a system and method for information handling system chassis bulk packaging for automated extraction of the chassis from packaging.

2. Description of the Related Art

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

Often different components of an information handling system are manufactured at a variety of disparate locations and then shipped to a manufacturing location for final assembly. The packaging and assembly of components typically involves combined manual and robotic labor. For instance, less complex information handling system components, such as the housing chassis, are sometimes manufactured and bulk packaged at remote locations with less-specialized manual labor. The chassis are then shipped in the bulk packages for assembly at a location with more specialized labor and robotics that are better able to manage the complex manufacturing process of assembling electronic components in the chassis. The allocation of tasks of varying complexity to appropriate labor resources improves manufacturing efficiency and reduces costs, however, this improved efficiency may easily be lost if packaged components are not adequately adapted to integrate in the assembly process. For instance, chassis are typically wrapped in protective plastic and placed in partitioned corrugated containers for shipment to an assembly location. At the assembly location, a robotic arm equipped with a vacuum lift removes the chassis from the container for use in assembly of information handling systems.

One difficulty with the integration of component packaging and system assembly is that protective packaging material is sometimes removed along with components at the assembly location to interfere with and introduce contaminants into the assembly process. For instance, a chassis that is extracted by a robotic arm vacuum lift from a container will sometimes pull up the protective plastic wrap from within the partitioned container during the extraction. Once a protective plastic wrap is pulled from a container partition the robotic arm lift process generally fails due to interference with the robotic vision or movement of the robotic arm. In addition, removal of the plastic protective wrap increases the risk that contaminants in the container beneath the wrap will enter the assembly environment to cause damage to other more-sensitive information handling system components. One solution to the inadvertent removal of a protective plastic wrap is to glue or otherwise adhere the plastic wrap to the container to prevent the inadvertent removal. However, gluing dissimilar materials inhibits reuse or recycling of packaging material after the components are removed for assembly since the adhered packaging materials are generally infeasible to separate completely, making recycling of each individual material void.

SUMMARY OF THE INVENTION

Therefore a need has arisen for a system and method which packages components in a protective plastic wrap without subsequently interfering with a manufacturing process that assembles a system from the component.

In accordance with the present invention, a method and system are provided which substantially reduce the disadvantages and problems associated with previous systems and methods for packaging components for subsequent use in a manufacturing process. Components are packaged in container partitions with a protective bag having extensions removably coupled to the container and a vacuum release to relieve the vacuum created by extraction of a component and thus aid with retention of the protective bag in the partition during extraction of the component.

More specifically, information handling system housing chassis housings are bulk packaged in a corrugated container having a partition and a protective bag for each chassis. The protective bag has an opening to a main body sized to accept a chassis and to enclose the chassis disposed in a partition. Slots on opposing sides of each partition accept coupling extensions on opposing sides of the protective bag to removably couple each protective bag in its respective partition by slipping each extension through an associated slot and twisting the bag. Vacuum release openings cut in the bottom portion of the bag allow air to pass between the protective bag and the partition to relieve any vacuum created by extraction of the chassis from the protective bag. The upper surface of the chassis is exposed by the protective bag opening to provide access by a robotic arm for automated extraction of the chassis from the partition. The protective bag couples to the container partition and equalizes the vacuum created by removal of the chassis to prevent inadvertent withdrawal of the protective bag that would interfere with robotic vision controlling the robotic arm. In one embodiment, the protective bag is die-cut from a polyethylene material to have rectangular extensions associated with the upper portion of the bag and triangular openings associated with the lower portion of the bag.

The present invention provides a number of important technical advantages. One example of an important technical advantage is that information handling system chassis are bulk packaged encased by a protective material that remains in the packaging when a chassis is removed. Retention of plastic protective material in a container partition aids automated extraction of components by preventing interference of the protective material with robotic vision equipment and aids assembly with the component by reducing the risk of contaminants entering the assembly area. Retention of the protective material without adhering dissimilar materials to each other, such as plastic adhered to corrugated cardboard by glue, provides improved manufacturing output without impacting the recycling of the packaging material. The protective bags are detached from the partition retaining slots to separate cardboard and plastic materials for recycling.

BRIEF DESCRIPTION OF THE DRAWINGS

The present invention may be better understood, and its numerous objects, features and advantages made apparent to those skilled in the art by referencing the accompanying drawings. The use of the same reference number throughout the several figures designates a like or similar element.

DETAILED DESCRIPTION

Protective bags package information handling system components to support automated unpackaging and recycling of packaging materials with removable coupling of the protective bag to the packaging container and a vacuum release that relieves a vacuum created during automated extraction of the information handling system component from the container. For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communicating with external devices as well as various input and output (I/O) devices, such as a keyboard, a mouse, and a video display. The information handling system may also include one or more buses operable to transmit communications between the various hardware components.

Figure 1:
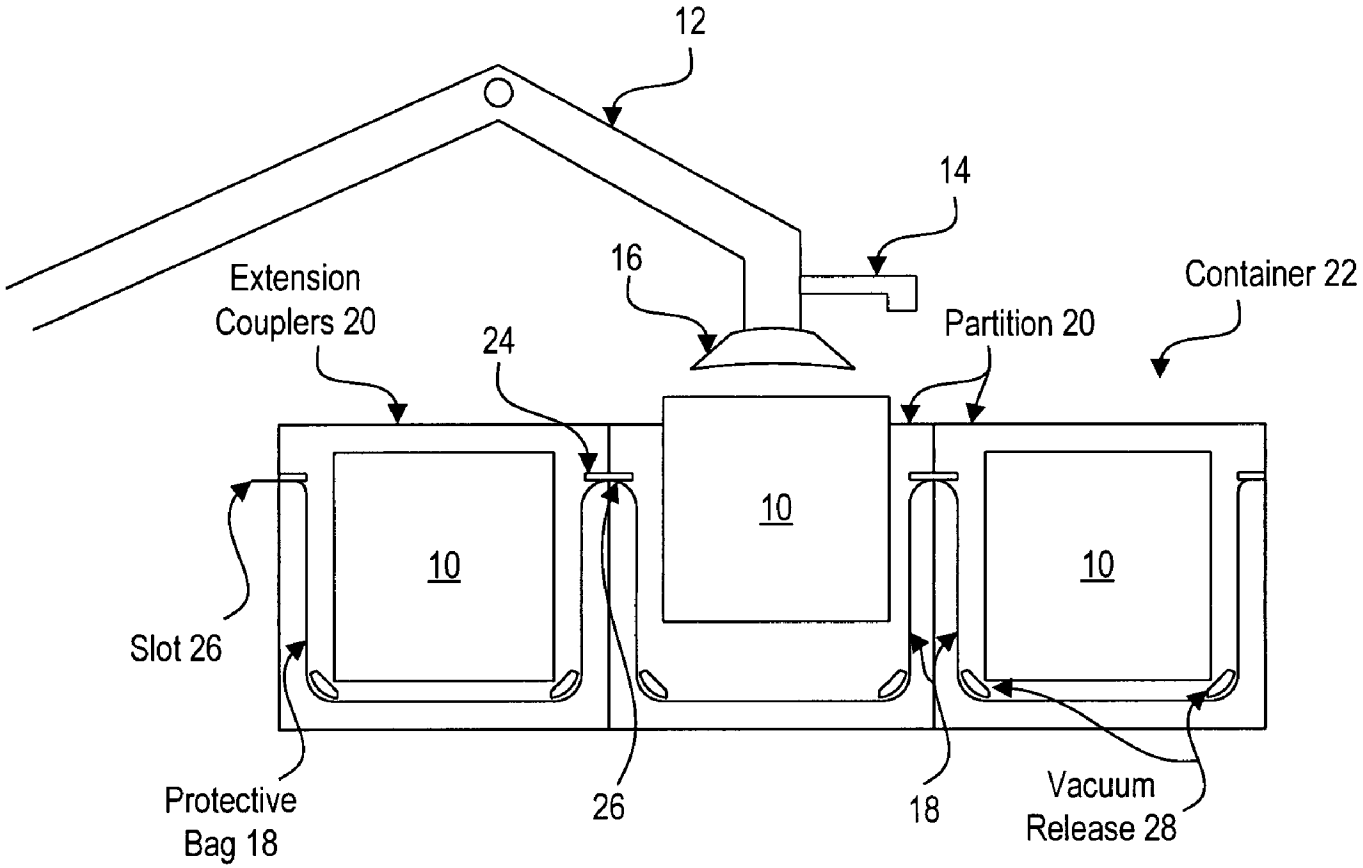
FIG. 1 depicts a side cut away view of bulk packaged information handling system chassis aligned for automated extraction by a robotic arm.

Referring now to FIG. 1, a side cut away view depicts bulk packaged information handling system chassis housings 10 aligned for automated extraction by a robotic arm 12. Robotic arm 12 has a vision mechanism 14 that guides a lifting mechanism 16, such as a suction-based lifting mechanism, to align with and couple to chassis 10. The use of robotic equipment for movement and assembly of information handling system components increases efficiency and reduces labor costs unless the robotic equipment fails and thus requires manual intervention to maintain proper operations. One cause of failure is contamination by packaging material of the robotic arm operating area, such as material that interferes with robotic vision 14. To limit the introduction of contaminants from the packaging material to the assembly environment, a protective bag 18 encases each chassis within a partition 20 of a bulk package container 22.

Protective bag 18 helps to contain contaminants within a partition 20 but is also susceptible to inadvertent extraction from partition 20 during removal of a chassis 10. For instance, as robotic arm 12 lifts a chassis 10, small projections or electrostatic force may lift protective bag 18 along with chassis 10. Similarly, a vacuum that forms as chassis 10 lifts from protective bag 18 may lift protective bag 18 out of partition 20. Once protective bag 18 leaves its partition, it may interfere with the operation of robotic arm 12 or vision mechanism 14 leading to a failure of automated extraction of chassis 10 and perhaps a shutdown of the assembly process until a technician is able to remove the offending protective bag and reset the assembly process. In order to removably secure protective bag 18 to container 22, opposing extension couplers 24 attach protective bag 18 to opposing slots 26 in the upper portion of a partition 20 to secure the upper portion of protective bag 18 to the partition without an adhering glue. A vacuum release 28, depicted as opposing triangular cuts at the bottom portion of protective bag 18, relieves the vacuum created by extraction of a chassis 10 from a partition 20 by allow air to pass through. The extension couplers and vacuum release cooperate to maintain protective bag 18 in partition 20 during extraction of a chassis 10 without permanent adherence of the bag to the container that would inhibit recycling or reuse of the packaging materials.

Figure 2:
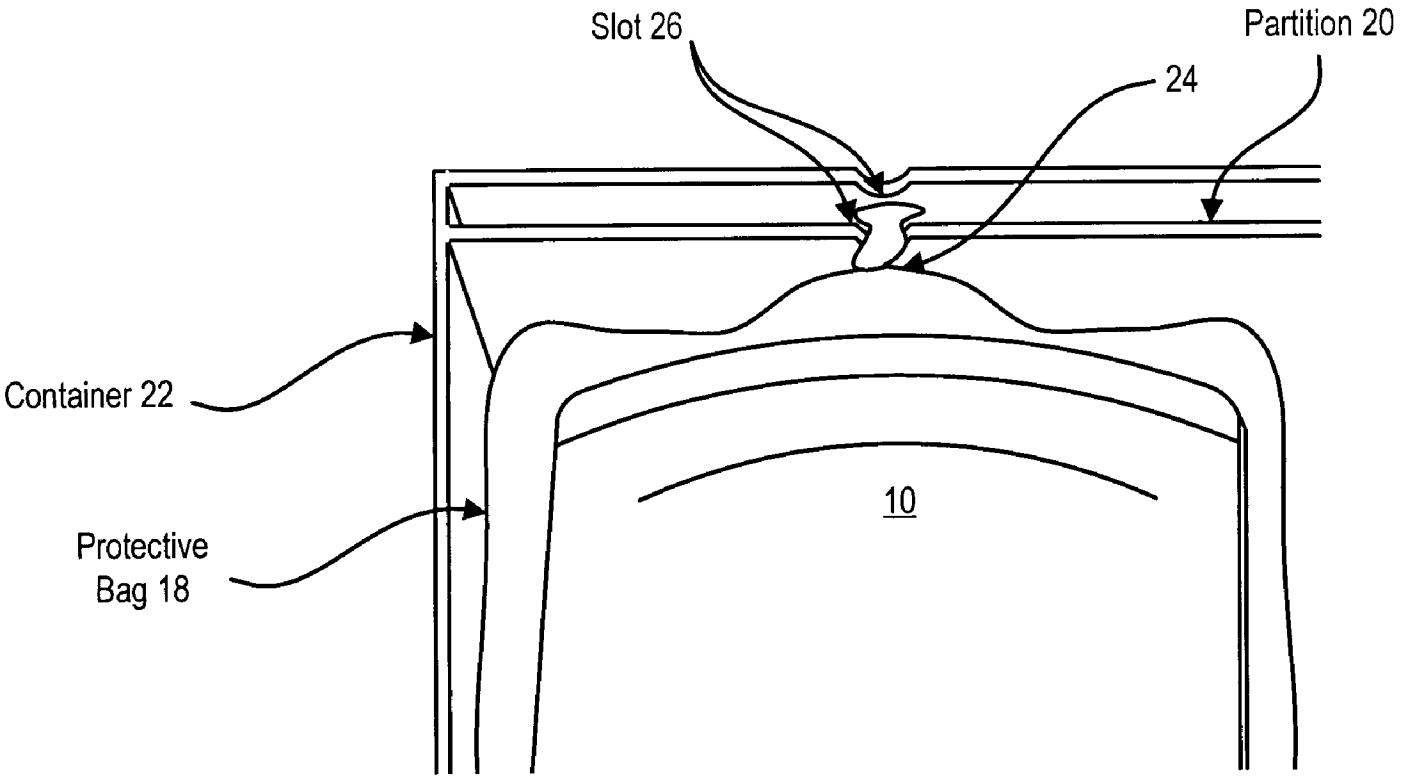
FIG. 2 depicts a top view of an information handling system chassis exposed for automated extraction.

Referring now to FIG. 2, a top view of chassis 10 packaged in a partition 20 depicts a protective bag 18 encasing chassis 10 with the upper surface of chassis 10 exposed for coupling by a robotic arm lifting mechanism 16. Protective bag 18 lines the inner surface of partition 20 and has an open upper portion that accepts an inserted chassis 10. Chassis 10 are bulk packaged in a container having plural partitions by inserting a chassis 10 into a protective bag 18 and then inserting protective bag 18 with the chassis 10 into an empty partition 20. Extension couplers 24 insert through slots 26 and are tied or twisted to removably couple protective bag 18 to container 22. In alternative embodiments, different types and sizes of components are packaged by use of varying sized protective bags 18 and partitions 20.

Figure 3:
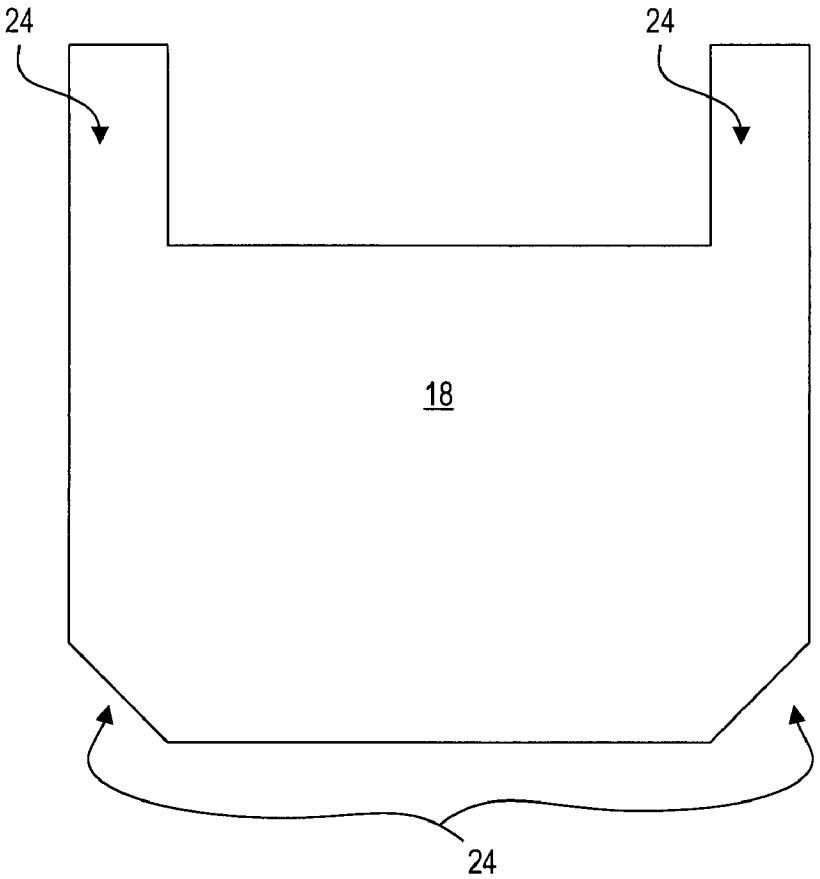
FIG. 3 depicts a side view of a die-cut polyethylene protective bag.

Referring now to FIG. 3, a side view of a protective bag 18 adapted for removable coupling to a container 22 is depicted. Protective bag 18 is die-cut from polyethylene material to form extension couplers 24 and vacuum release 28. Extension couplers 24 are rectangular pieces of material that provide sufficient strength to hold protective bag 18 within a partition 20 and sufficient bulk so that tying or twisting will restrict movement through a partition slot 26. Vacuum release 28 is opposing triangular cuts at the bottom corner of protective bag 18 that leave an opening for air passage to relieve a vacuum created by extraction of an object from within protective bag 18. Protective bag 18 is formed to open at a top opening 30 for insertion and removal of an object into and out of the interior of protective bag 18. Packing of a component is accomplished by opening protective bag 18 to insert the component through opening 30.

Although the present invention has been described in detail, it should be understood that various changes, substitutions and alterations can be made hereto without departing from the spirit and scope of the invention as defined by the appended claims.

What is claimed is:

1. An information handling system bulk component package comprising:

a container having plural partitions, each partition sized to accept a component and having an information handling system chassis packaged in each partition; and opposing slots; and a protective bag for each partition, each protective bag having an upper and lower portion and sized to encase a component in a partition;

wherein each protective bag has opposing extensions associated with the upper portion operable to couple to the partition slots and at least one opening associated with the lower portion operable to pass air, the extensions and opening aiding retention of a protective bag in a partition during extraction of a component from the partition; and wherein the protective bag has an opening in the upper portion sized for extraction of the chassis from the protective bag by a robotic arm.

2. The information handling system bulk component package of claim 1 wherein the protective bag couples to the slots by slipping an extension of the protective bag in each of the slots.

3. The information handling system bulk component package of claim 1 wherein the protective bag comprises a die-cut polyethylene bag.

4. The information handling system bulk component package of claim 3 wherein the extensions comprise die-cut rectangular blocks extending from the upper portion of the bag.

5. The information handling system bulk component package of claim 3 wherein the openings comprise opposing triangular cut openings at the lower portion of the bag.

* * * * *